United States Patent [19]

Durand

[11] Patent Number: 4,640,417

[45] Date of Patent: Feb. 3, 1987

[54] DISPLAY-PACKING UNIT FOR GLASSES AND SIMILAR ARTICLES

[75] Inventor: Philippe Durand, Arques, France

[73] Assignee: Verrerie Cristallerie d'Arques J. G. Durand & Cie, Arques, France

[21] Appl. No.: 721,225

[22] Filed: Apr. 9, 1985

[30] Foreign Application Priority Data

Apr. 9, 1984 [FR] France ..... 84 05570

[51] Int. Cl.[4] ..... B65D 85/44

[52] U.S. Cl. ..... 206/426; 206/45.14; 229/40; 229/41 R; 229/41 B

[58] Field of Search ..... 206/45.14, 45.17, 426, 206/171, 172, 173; 229/15, 29 R, 29 B, 40, 41 R, 41 B, 28 R, 39 R

[56] References Cited

U.S. PATENT DOCUMENTS

| | | | |
|---|---|---|---|
| 2,835,429 | 5/1958 | Pellaton | 229/41 R |
| 3,089,283 | 5/1963 | Kirkpatrick | 229/41 R |
| 3,116,851 | 1/1964 | Lemon | 229/28 R |
| 3,148,769 | 9/1964 | Bryant | 229/41 R |
| 3,278,076 | 10/1966 | Graser | 206/173 |
| 3,330,463 | 7/1967 | Wood | 229/40 |
| 3,514,031 | 5/1970 | Burgess | 229/28 R |
| 3,598,302 | 8/1971 | Nowak | 229/40 |
| 3,840,171 | 10/1974 | Waters | 229/29 B |
| 3,999,660 | 12/1976 | Tranquillitsky | 229/40 |
| 4,089,457 | 5/1978 | Wood et al. | 229/28 R |
| 4,130,237 | 12/1978 | Struble | 229/40 |
| 4,179,061 | 12/1979 | Gilbert | 229/41 B |
| 4,227,640 | 10/1980 | Roccaforte | 206/173 |
| 4,381,057 | 4/1983 | Carver | 206/485 |

*Primary Examiner*—William Price
*Assistant Examiner*—David T. Fidei
*Attorney, Agent, or Firm*—Gottlieb, Rackman & Reisman

[57] ABSTRACT

The invention provides a display packing for glasses and similar articles, which may be folded flat and is formed from a single strip of material. Said strap of material is divided into sections for forming the vertical an horizontal side walls of the frame as well as partition walls the number of which depends on the number of articles disposed in the row, each article in the row being separated from the next one by a partition wall. Locking lugs are engaged in notches of the lower and upper end portions of the vertical partition walls so as to hold the assembly opened out.

10 Claims, 11 Drawing Figures

A
1
2
3
4
5
6
7
8
9
10
11a
11b
11c
11d
11e
11f
11g
11h
12
14
14a
14b
14c
14d
15
16
16a
16b
16c
16d
17

DISPLAY-PACKING UNIT FOR GLASSES AND SIMILAR ARTICLES

BACKGROUND OF THE INVENTION

The invention relates to a packing-display unit for articles such as glasses and tumblers, the articles being disposed in rows, which may be folded flat.

A large number of packings are known in the art, which are formed from a cardboard or similar material blank, having fold lines, cut-outs and different means for opening out the blank by the formation of flaps, lugs, slots and notches, by bonding or stapling.

Glasses, tumblers or similar articles are generally sold in display packings formed by boxes having a bottom, two large side walls and two small side walls, the glasses being held in position by flaps and tongues. A cover with or without transparent window may also be provided.

Attention has turned to providing a totally transparent packing, i.e. not having a bottom and, in this case, to ensure the rigidity of the assembly it is necessary to provide partition and stiffening walls between the different articles. It is of course possible to add these partition walls only after the packing frame has been formed, but that requires additional handling and does not allow automatic manufacture however.

SUMMARY OF THE INVENTION

The invention provides a display packing, which may be folded flat, formed from a strip of material which, by folding and bonding, forms a packing frame surrounding the articles disposed in a row. The frame comprises a partition wall between each two adjacent articles in the row, with multi-panel locking tongues or lugs adjoining the strip by fold lines and coacting with grooves or notches in the interior partition wall or walls so as to hold them in a vertical position when the packing is opened out.

In the case where the packing is intended for articles disposed in two rows, at least one of the vertical side walls and the vertical partition wall or walls are cut out so as to form in each article-receiving compartment a tongue or article-separating dividing wall which, by folding it inwardly of the frame, forms a housing for the lower part of the article.

BRIEF DESCRIPTION OF THE DRAWINGS

The invention will now be described in greater détail with reference to the accompanying drawings in which.

DESCRIPTION OF THE PREFERRED EMBODIMENTS

Figures 1, 2:
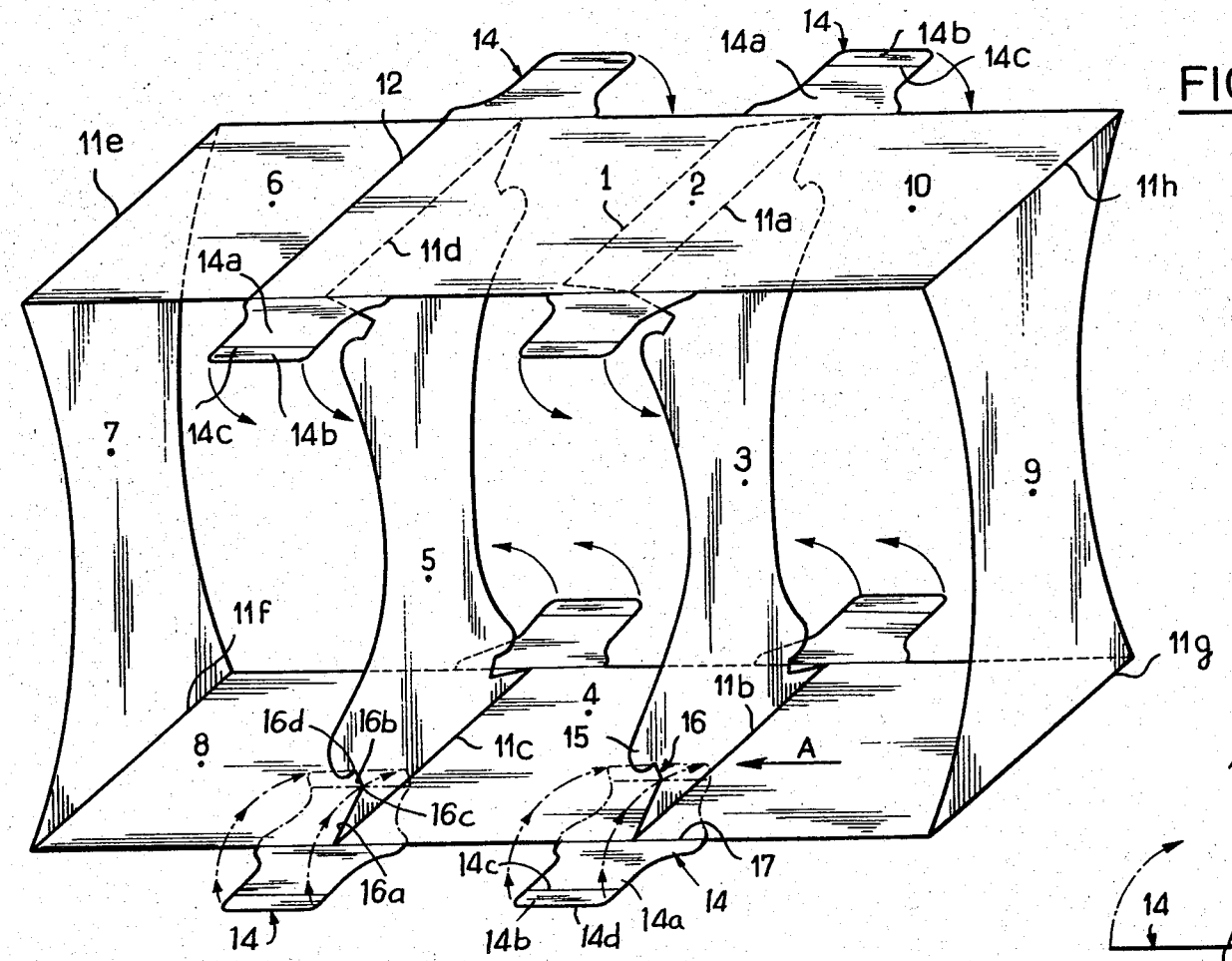
FIG. 1 is a schematic perspective view of a display packing in accordance with the invention.
FIG. 2 is a partial view in the direction of arrow A of FIG. 1 showing the tongues locking the vertical partition walls.

FIG. 1 shows in a perspective and schematic view a first embodiment of a packing of the invention. This packing is intended for presenting three articles disposed in a row. It is formed from a cardboard blank or from a similar material, generally rectangular in shape. If we consider this blank starting from end 1 at the left of FIG. 3*a*, it is formed from the following elements or sections separated by fold lines:

a bonding flap 2, a vertical partition wall 3, a section 4 lining one large side wall 8 of the frame, a vertical partition wall 5, a section 6 forming part of an other large side wall of the frame, a small side wall 7 of the frame, said one large side wall 8 of the frame, a small side wall 9 of the frame and a section 10 which, with section 6, complete said other large side wall of the frame. These different elements are separated by fold lines 11*a* to 11*h*. Line 11*i* is not really a fold line but a line for defining the bonding position.

Elements 8 and 10 of a generally rectangular shape each have four locking tongues projecting via fold lines 17 from each side of the section (two tongues on each side). Said tongues are centered on the line corresponding to the subsequent position of the vertical interior partition walls 3 and 5 and comprise a main portion or first tongue panel 14*a* separated from an end portion or second tongue panel 14*b* by a medial fold line 14*c*.

Sections 7 and 9 defining the end walls of the display packing may be rectangular but generally have two concave sides, said concave sides forming the vertical edges of the small sides or end walls of the frame, when said frame is opened out, so as to better show the article contained in the frame and to lighten the appearance of the packing. The edges of the partition walls 3 and 5 which will subsequently be in a vertical position are also concave from the same reasons. The upper and lower end portions of the vertical partition walls 3 and 5 comprise in each case a groove or notch 16 having a first straight edge region 16*a* extending inwardly of the wall and corresponding in length to the dimension of the respective first tongue panel 14*a* between the fold lines 17 and 14*c*, a second straight edge region 16*b* extending from a juncture 16*c* thereof with the first edge region 16*a* outwardly of the wall at an angle to the first edge region and corresponding in length to the dimension of the second tongue panel 14*b* between the medial fold line 14*c* and the free end edge 14*d* of the second tongue panel, and a projection 15 extending from a juncture 16*d* thereof with the second edge region 16*b* outwardly of the wall so as to overlie the portion of the first edge region 16*a* adjacent the juncture thereof with the second edge region 16*b*. Thus, each groove 16 is configured to receive an associated tongue 14 when the display packing is opened out into its article-receiving state with the first tongue panel 14*a* resting against the first straight edge region 16*a*, the second tongue panel 14*b* resting against the straight edge region 16*b*, and with the free end edge 14*d* of the second tongue panel hooked behind the projection 15 at its juncture 16*d* with the second edge region 16*b*.

Figures 3A, 3B, 3C, 3D, 4:
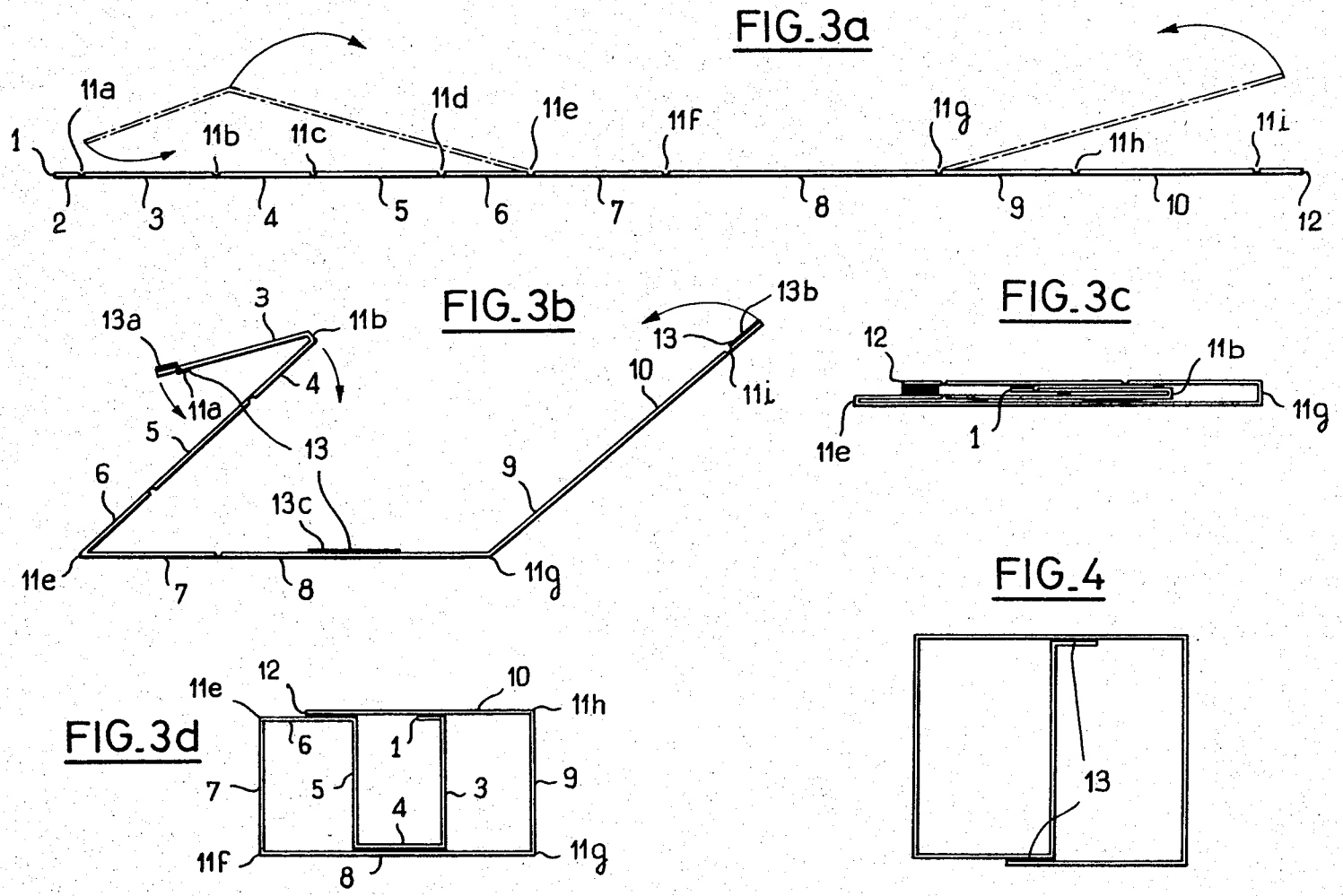
FIGS. 3*a*, 3*b*, 3*c* and 3*d* illustrate the folding of a cardboard blank, so as to form the frame shown in FIG. 1.
FIG. 4 is a side view of a packing for two articles.

FIGS. 3*a* to 3*d* illustrate the folding and bonding of the blank so as to obtain the opened out frame. The full line drawing in FIG. 3*a* shows the rectangular blank when flat, the fold lines 11 being shown by slight identations; the dot and dash lines show the beginning of folding the blank. To this end, the folding begins along the fold lines 11*b*, 11*e* and 11*g*, sections 2 and 3 being brought under sections 4, 5 and 6 whereas the latter and sections 9 and 10 pivot upwardly about the fold lines 11*e* and 11*g*. Spots of glue are deposited on section 2, on section 8 and on the strip defined by line 11*i* and the end 12 of the blank, and are designated respectively by 13*a*, 13*c* and 13*b* in FIG. 3*b*. The folding is continued by first bringing sections 4, 5 and 6, over which sections 2 and 3 have been folded, against section 8, and sections 9 and 10 are folded over the whole so as to form the flat assembly shown in an exaggerated form in FIG. 3*c*.

During opening out of the frame, the blank folds itself about lines 11*a*, 11*c*, 11*d*, 11*f* and 11*h* whereas the other sections stand up straight with respect to the fold already effected along lines 11*b*, 11*e* and 11*g*. The frame thus obtained is then locked by folding each of the tongues 14 about the respective fold line 17 and introducing its end portions 14*b* in notch 16 of the associated one of the partition walls 3 and 5 as shown in FIG. 2. It will be appreciated that, as each tongue 14 is bent about its inner fold line 17, the associated projection 15 functions in a cam-like manner to cause the tongue panel 14*b* to be bent about its medial fold line 14*c* until that tongue panel can snap up behind the projection 15. The display packing will then remain locked in its article-receiving state until the tongue is positively removed from the groove, by bending the tongue panel 14*b* out of its rest position about the fold line 14*c* so as to clear the projection 15. The tongue cannot be unlocked by pressing down on the tongue panel 14*a*. The locking of the frame or display packing may obviously be carried out after introduction of the articles which are to be packed.

It will be noted in FIG. 1 that each tongue 14 has curved lateral edges, i.e., is by bilaterally configured, for engagement against the cylindrical wall of the lower part of a tumbler or so as to rest above the foot of a stemmed glass.

FIG. 4 is a side view of a packing of the invention for two articles side by side. In this case the frame only comprises a single partition wall and a man skilled in the art will easily determine the method of folding same from examining FIG. 4 and FIGS. 3*a* to 3*d*.

In practice, the frame shown in FIG. 1 will often be used by reversing it, so that the bonding of end 12 of section 10 is on the lower side of the frame and not on the upper side as shown in FIG. 3*d*.

Figure 5:
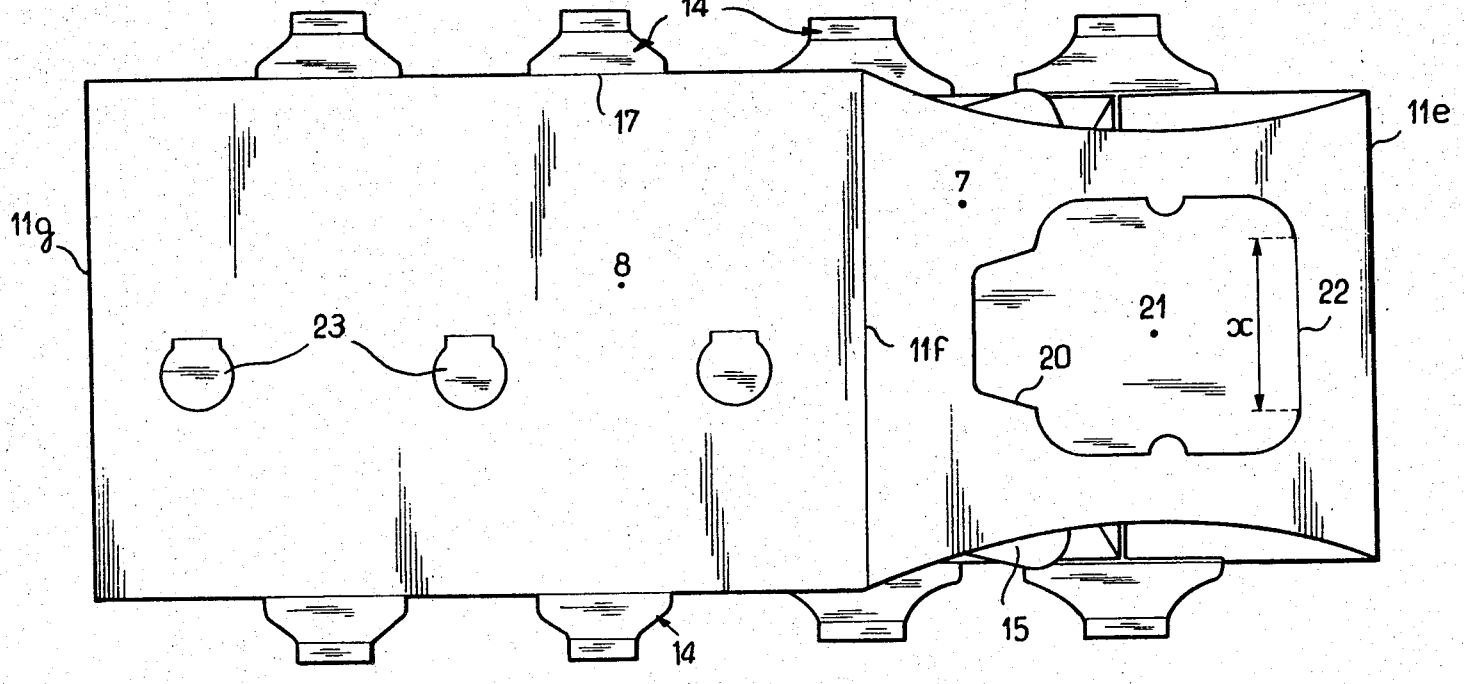
FIG. 5 is a top view of a folded and bonded packing, before being opened out, according to a modified embodiment of the invention.
Figures 6, 7:
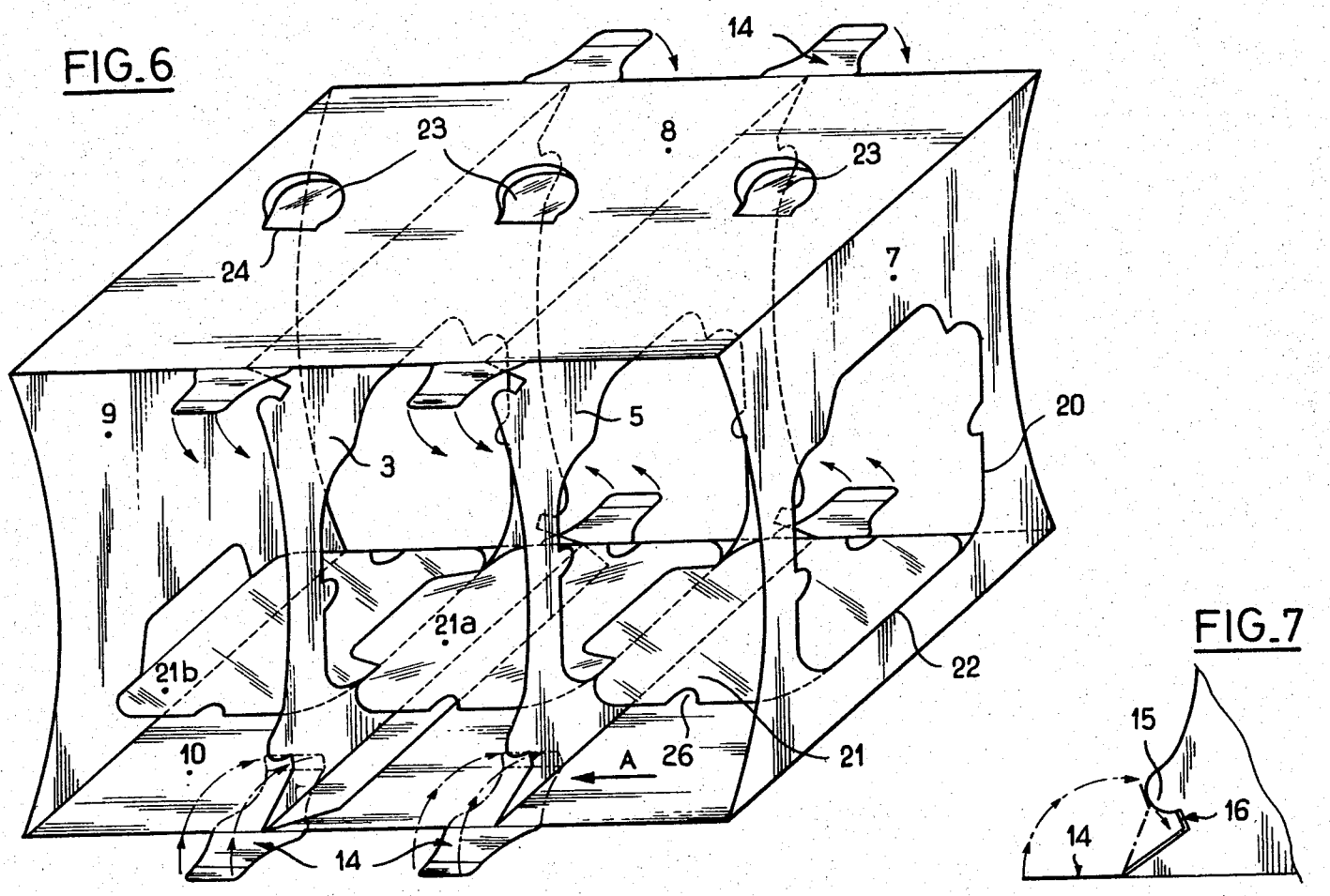
FIG. 6 is a perspective view of the packing of FIG. 5 once opened out.
FIG. 7 is a partial view in the direction of arrow A of FIG. 6, showing the locking of the tongue in the dividing wall.

FIGS. 5, 6 and 7 show another embodiment of the invention for packing six articles in two rows of three objects. The reference numbers identical to those previously used designate the same elements.

FIG. 5 is a top view of a frame according to said other embodiment, once folded and bonded but still flat. Section 8 comprises four tongues 14 joined to section 8 by the fold lines 17. In this Figure there can also be seen the fold line 11*f* between section 8 and section 7 which will form one of the vertical side walls of the frame, whereas the fold lines 11*e* and 11*g* form the two ends of the folded flat frame. The two free edges of section 7 are curved for lightening the outer appearance of the frame and so as to better show the elements which it contains. A cut-out 20 defines a tongue 21 which is joined to section 7 only by fold line 22 of length x. The shape of cut-out 20 and so of tongue 21 is such that tongue 21, by being folded inwardly of the frame, forms a housing or dividing wall for the lower portion of the packed articles. In the case shown in FIGS. 5 and 6, tongue 21 comprises two indentations 26 of semi-circular shape the diameter of which corresponds to the diameter of the stem of stemmed glasses which are to be packed in the frame. The end portion of the tongue 21 opposite the fold line 22 is narrowed so as to facilitate its engagement in a notch in the partition wall which follows it or so as to facilitate its bonding against the opposite wall.

FIG. 6 shows the frame of FIG. 5, once opened out. It can be seen that the frame comprises two vertical side walls 7 and 9, only one of which (side wall 7) is cut-out and comprises a tongue 21. The vertical partition walls 3 and 5 are similarly cut-out so as to form tongues 21*a* and 21*b*. The endmost portions of tongues 21 and 21*a* fit into the openings in partition walls 5 and 3 respectively and are bonded respectively to tongue 21*a* and to tongue 21*b*. The end portion of tongue 21*b* is folded and bonded to side-wall 9. As in the case of FIG. 1, tongues 14 are folded inwardly against the straight edges 16*a* and 16*b* of the respective notches or grooves 16 and the portion 14*b* of each tongue is fitted into the associated notch or groove 16 in partition walls 3 and 5 and is hooked behind the respective projection 15, as shown in FIG. 7.

The frame of FIG. 6 is shown in the position of use, i.e. in an upside down position with respect to the position of the frame shown in FIG. 1. It can be seen that the upper section 8 comprises three cut-outs defining flaps 23 which are folded inwardly of the frame for preventing the rims of the glasses from chinking against each other. These flaps 23 are joined to section 8 by fold lines 24 along their rectilinear parts.

The method of folding and bonding the frame is identical to that used for the frame shown in FIGS. 1 to 3.

It is clear that the frame shown in FIG. 6 may be modified so that tongues 21, 21*a* and 21*b* allow tumblers and not stemmed glasses to be placed therein. Similarly, a cut-out 20 could be made in wall 9, opposite that in wall 7, and tongue 21*b* could come then from a cut-out in wall 9 with suppression of the tongue coming from wall 3; similarly, a cut-out could be provided in wall 9 while suppressing the tongue which would result therefrom.

Figure 8:
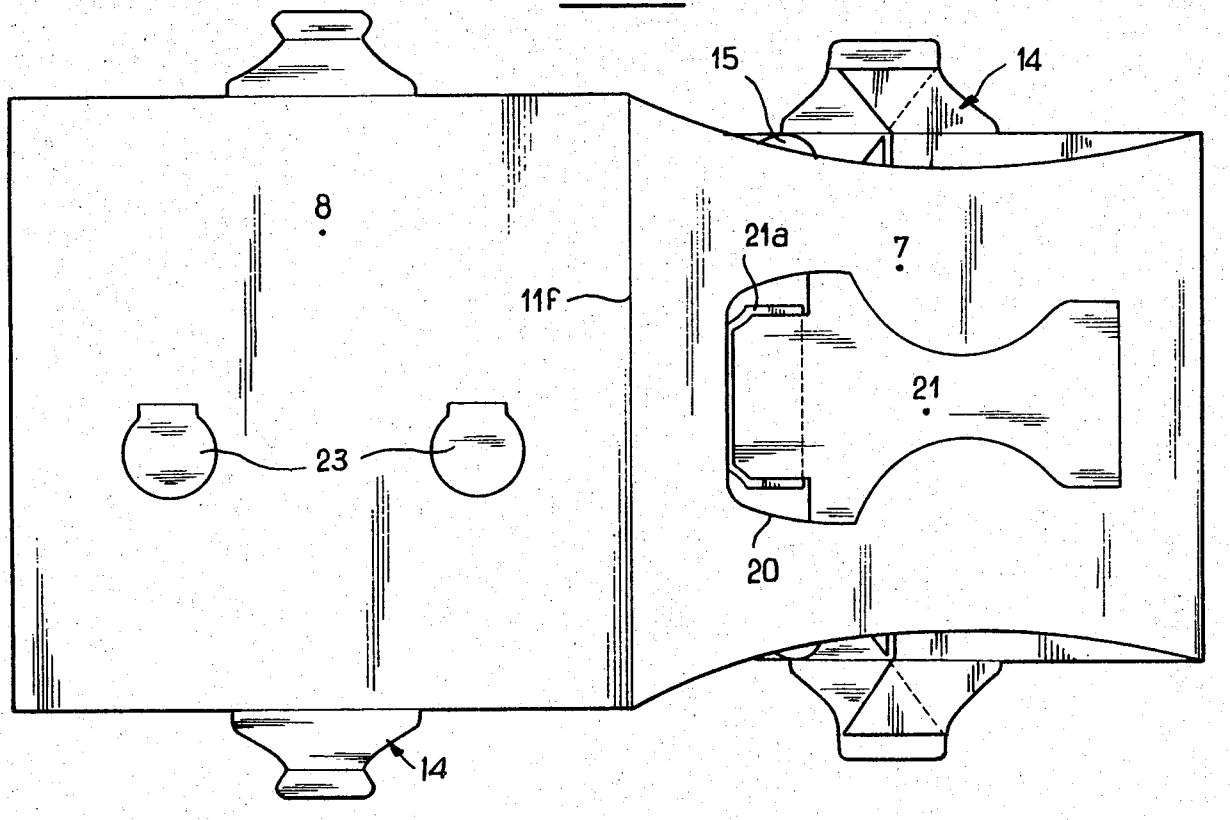
FIG. 8 is a top view of another packing in accordance with the invention, once folded and bonded and laid flat.

FIG. 8 is a top view similar to that of FIG. 5 but showing a modified embodiment of the display packing of the invention intended for packing four tumblers. In this case, cut-out 20 has a shape for accomodating tumblers, and not stemmed glasses, and the front portion of tongue 21 is slightly narrowed for sticking to the portion of tongue 21*a* cut-out from the intermediate partition wall the lower rounded ends or projections 15 of which can be seen in FIG. 8. Joining together of the two ends of the rectangular blank taking place in this particular case at the level of the single central partition wall, the lower tongues 14 are in two pieces at the two ends of the blank and come into overlapping relation during building up of the frame. It is obvious that many modifications can be made to the frames which have been described above, in particular to the shape of the cut-outs, the shape of the vertical side walls and of the vertical partition walls, the shape of the tongues and the shape of the notches with which they cooperate for locking the frame. The frame of the present invention have the following advantages. They are produced from a single rectangular blank by cutting out, folding and bonding only. The manufacture may then be accomplished automatically on so called multipurpose machines. The packings obtained in the flat condition are stored flat but they may be opened out instantaneously. They may be filled by hand but also by machine because of the easy access to each position. Once they are filled, the locking tongues or lugs are positioned in a very simple way, but it is still possible to remove and replace the articles by unlocking the tongues without damaging the packing frame.

The different types of packing frames are readily adaptable to the different articles which it may be desired to introduce therein, and some of them may be used for any type of articles, i.e. either stemmed glasses or cylindrical tumblers. This is the case for example for the frames shown in FIGS. 1 and 4.

All the articles contained in the packing are readily visible and because there is no bottom, they gain in luminosity.

For improving safety during transport, it is obviously possible to add one or more bands or hoops for better holding the articles in position.

The frame may be made from different materials lending itself to cutting out, folding and gluing as well as to the indication by different means (labelling, printing, etc) of the different captions which it is desired to place on the packing.

What is claimed is:

1. A collapsible and erectable display packing for glasses and similar objects, said display packing being formed from a generally rectangular cardboard blank having parallel transverse fold lines therein defining a plurality blank panels adapted to constitute wall sections of said display packing, said display packing having, when in an object-receiving state, a plurality of alternately upper and lower horizontal wall sections interconnected by vertical wall sections, a respective projecting tongue formed at each of the opposite side edges of each blank panel defining a horizontal wall section which in the object-receiving state of the display packing bridges a respective interior vertical wall section of the latter located intermediate the opposite ends of the display packing, each of said tongues having a first tongue panel connected along an inner fold line to the associated blank panel and further having a second tongue panel connected along a medial fold line to said first tongue panel and terminating in a free end edge, and a corresponding groove formed in each of the opposite side edges of each blank panel defining one of said respective interior vertical wall sections at the upper and lower regions thereof, each of said grooves having a first straight edge region extending inwardly of the respective blank panel from the associated side edge thereof at an acute angle to the associated transverse fold line and corresponding in length to the dimension of the respective first tongue panel between said inner and medial fold lines, a second straight edge region extending from a juncture thereof with said first edge region outwardly of the respective blank panel at an angle to said first edge region and corresponding in length to the dimension of the respective second tongue panel between said medial fold line and said free end edge, and a projection extending from a juncture with and at an angle to said second edge region outwardly of the respective blank panel so as to overlie the portion of said first edge region adjacent said juncture thereof with said second edge region, said grooves thereby being configured for receiving the associated tongues so that when the display packing is in its object-receiving state, said first tongue panel of each tongue rests flush against said first edge region of the associated groove, said second tongue panel rests flush against said second edge region, and said free end edge of said second tongue panel is hooked behind said projection at said juncture thereof with said second edge region, thereby to hold and lock the vertical wall sections in position.

2. A display packing according to claim 1, wherein each of said tongues is bilaterally configured in correspondence with the peripheral contours of the objects to be positioned in the display packing, each of said tongues when received in an associated groove being disposed to peripherally engage the two objects located on opposite sides of the respective vertical wall section for holding them in position in the display packing.

3. A collapsible and erectable display packing for glasses and similar objects, said display packing being formed from a cardboard or similar blank of generally rectangular shape having parallel transverse fold lines therein defining a plurality of blank panels adapted to constitute, in said display packing, when the same is in an object-receiving state, in sequence, a first upper horizontal wall section, a first vertical partition, a first lower horizontal wall section, a second vertical partition, a second upper horizontal wall section, a third vertical partition constituting one end wall of the display packing, a second lower horizontal wall section extending over the entire expanse of the display packing and covering said first lower horizontal wall section, a fourth vertical partition constituting the other end wall of the display packing, and a third upper horizontal wall section covering said first and at least a part of said second upper horizontal wall sections, a respective projecting tongue formed at each of the opposite side edges of said second lower and said third upper horizontal wall sections in the respective regions thereof where they bridge said first and second vertical partitions, each of said tongues having a first tongue panel connected along an inner fold line to the associated blank panel and further having a second tongue panel connected along a medial fold line to said first tongue panel and terminating in a free end edge, and a corresponding groove formed in each of the opposite side edges of said first and second vertical partitions at the upper and lower regions thereof, each of said grooves having a first straight edge region extending inwardly of the respective blank panel from the associated side edge thereof at an acute angle to the associated transverse fold line and corresponding in length to the dimension of the respective first tongue panel between said inner and medial fold lines, a second straight edge region extending from a juncture thereof with said first edge region outwardly of the respective blank panel at an angle to said first edge region and corresponding in length to the dimension of the respective second tongue panel between said medial fold line and said free end edge, and a projection extending from a juncture with and at an angle to said second edge region outwardly of the respective blank panel so as to overlie the portion of said first edge region adjacent said juncture thereof with said second edge region, said grooves thereby being configured for receiving the associated tongues so that when the display packing is in its object-receiving state, said first tongue panel of each tongue rests flush against said first edge region of the associated groove, said second tongue panel rests flush against said second edge region, and said free end edge of said second tongue panel is hooked behind said projection at said juncture thereof with said second edge region, thereby to hold and lock said first and second vertical partitions in position relative to said upper and lower horizontal wall sections.

4. A display packing according to claim 3, wherein each of said tongues is bilaterally configured in correspondence with the peripheral contours of the objects to be positioned in the display packing, each of said tongues when received in an associated groove being disposed to peripherally engage the two objects located on opposite sides of the respective vertical partition for holding them in position in the display packing.

5. A display packing according to claim 3, wherein each of those blank panels defining three of the four vertical partitions is provided with a respective medial cut section having two ends, each cut section being adapted to be bent at one end from its associated vertical partition toward and to be secured at its other end to the next adjacent vertical partition so as to constitute a substantially horizontal dividing member, said dividing members when so bent and secured forming two rows of spaces between said vertical partitions in the erected display packing for accommodating two rows of said objects.

6. A display packing according to claim 5, wherein each dividing member is bilaterally configured in correspondence with the peripheral contours of the objects to be positioned in the display packing and when bent and secured is disposed to peripherally engage the two objects in the two spaces formed between the same two adjacent vertical partitions.

7. A display packing according to claim 6, wherein those blank panels defining the respective regions of said upper horizontal wall sections which medially overlie the spaces between each two adjacent vertical partitions are provided with respective cut sections each adapted to be bent down from its associated upper horizontal wall section to constitute a contact-inhibiting buffer tab adapted to be inserted between the upper rims of two objects placed into the underlying spaces on opposite sides of the associated dividing member.

8. A collapsible and erectable display packing for glasses and similar objects, said display packing being formed from a generally rectangular cardboard or like blank having parallel transverse fold lines therein defining a plurality of blank panels adapted to constitute, when the display packing is in an object-receiving state, a plurality of alternately upper and lower horizontal wall sections interconnecting a plurality of vertical wall sections, a respective projecting tongue formed at each of the opposited side edges of each horizontal wall section in respective regions of the latter which are located intermediate the opposite ends of the display packing and at which that horizontal wall section bridges a respective vertical wall section, each of said tongues having a first tongue panel connected along an inner fold line to the associated blank panel defining a horizontal wall section and further having a second tongue panel connected along a medial fold line to said first tongue panel and terminating in a free end edge, a corresponding groove formed in each of the opposite side edges of each blank panel defining an interior vertical wall section, at the upper and lower regions thereof, which is juxtaposed to said respective regions of said horizontal wall sections, each of said grooves having a first straight edge region extending inwardly of the respective blank panel from the associated side edge thereof at an acute angle to the associated transverse fold line and corresponding in length to the dimension of the respective first tongue panel between said inner and medial fold lines, a second straight edge region extending from a juncture thereof with first edge region outwardly of the respective blank panel at an angle to said first edge region and corresponding in length to the dimension of the second tongue panel between said medial fold line and said free end edge, and a projection extending from a juncture with and at an angle to said second edge region outwardly of the respective blank panel so as to overlie the portion of said first edge region adjacent said juncture thereof with said second edge region, said grooves thereby being configured for receiving the associated tongues to hold and lock the associated vertical wall sections in position, horizontal object-separating dividing walls each extending from a respective vertical wall section toward the next adjacent vertical wall section and being affixed to said next adjacent vertical wall section by bonding, and cut-out buffer tabs depending from the upper horizontal wall sections in the regions of the latter intermediate two adjacent vertical wall sections.

9. A display packing according to claim 8, wherein each of said tongues is bilaterally configured in correspondence with the peripheral contours of the objects to be positioned in the display packing, each of said tongues when received in an associated groove being disposed to peripherally engage the two objects located on opposite sides of the respective vertical wall section for holding them in position in the display packing.

10. A display packing according to claim 8, wherein each dividing wall is cut in tongue fashion from its respective vertical wall section and is bilaterally configured in correspondence with the peripheral contours of the objects to be positioned in the two spaces defined between the same two adjacent vertical wall sections in the display packing.

* * * * *